US006755184B2

(12) United States Patent
Seskes

(10) Patent No.: US 6,755,184 B2
(45) Date of Patent: Jun. 29, 2004

(54) FUEL SYSTEM HAVING A VENT STRUCTURE FOR COMMUNICATING WITH A FUEL CANISTER

(75) Inventor: Brian Joseph Seskes, Hilliard, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 10 days.

(21) Appl. No.: 10/211,390

(22) Filed: Aug. 2, 2002

(65) Prior Publication Data

US 2004/0020476 A1 Feb. 5, 2004

(51) Int. Cl.[7] ..... F02M 33/02
(52) U.S. Cl. ..... 123/519; 123/518
(58) Field of Search ..... 123/516, 518, 123/519, 520, 198 E; 96/139; 55/413, 415, 426

(56) References Cited

U.S. PATENT DOCUMENTS

| | | | | |
|---|---|---|---|---|
| 4,628,689 A | * | 12/1986 | Jourdan | 60/295 |
| 4,693,393 A | | 9/1987 | DeMinco et al. | |
| 4,706,840 A | | 11/1987 | Thompson | |
| 4,854,469 A | | 8/1989 | Hargest | |
| 4,887,652 A | * | 12/1989 | Bucci | 141/59 |
| 4,971,219 A | | 11/1990 | Dombeck et al. | |
| 5,000,768 A | * | 3/1991 | Hwang | 55/308 |
| 5,078,901 A | | 1/1992 | Sparrow | |
| 5,088,947 A | | 2/1992 | Whitley, II et al. | |
| 5,149,347 A | * | 9/1992 | Turner et al. | 55/446 |
| 5,647,333 A | | 7/1997 | Mukai | |
| 5,692,637 A | | 12/1997 | Hodge | |
| 5,858,034 A | | 1/1999 | Shida et al. | |
| 5,906,189 A | | 5/1999 | Mukai et al. | |
| 5,912,368 A | | 6/1999 | Satarino et al. | |
| 6,276,387 B1 | | 8/2001 | Pachciarz et al. | |
| 6,279,548 B1 | | 8/2001 | Reddy | |
| 6,328,442 B1 | * | 12/2001 | Brinkly | 347/104 |
| 6,382,192 B2 | | 5/2002 | Kitajima et al. | |
| 6,592,655 B2 | * | 7/2003 | Iriyama et al. | 96/138 |

* cited by examiner

*Primary Examiner*—Mahmoud Gimie
(74) *Attorney, Agent, or Firm*—Fay, Sharpe, Fagan, Minnich & McKee, LLP

(57) ABSTRACT

An evaporative fuel system includes a canister connected to a fuel tank for receiving vapors therefrom and a conduit having a first end connected to the canister. A vent structure is connected to a second end of the conduit. The vent structure includes a housing, a first port formed in the housing and connected to the conduit, and a second port formed in the housing and connected to atmosphere. A chamber portion is formed by the housing and is in airflow communication with the second port. A tubular portion is formed by the housing and is in airflow communication with the first port and the chamber portion. The tubular portion extends into the chamber portion. A baffle is adjacent the second port and extends into the chamber. The baffle and the tubular portion together define a sinuous path portion of an air passageway extending between the first port and the second port.

20 Claims, 3 Drawing Sheets

FUEL SYSTEM HAVING A VENT STRUCTURE FOR COMMUNICATING WITH A FUEL CANISTER

BACKGROUND OF THE INVENTION

1. Field of the Invention

The present invention relates to a control system for fuel vapors released from a vehicle fuel tank and, more particularly, to a vent structure for admitting and exhausting air to and from a fuel canister connected to a vehicle fuel tank while preventing water, snow and the like from entering the same. The present invention finds particular application as a joint box for filter and drain tubes connected to a fuel canister and will be described with particular reference thereto. It is to be appreciated, however, that the invention may relate to other similar environments and applications.

2. Description of the Prior Art

It is known that a vehicle's fuel tank often holds fuel vapor in addition to any amount of liquid fuel stored in the fuel tank. When the fuel tank is being filled with liquid fuel, an amount of the fuel vapor may be displaced from the fuel tank. Similarly, if the temperature of the vehicle fuel tank rises, an amount of the fuel vapor may be displaced. For environmental reasons, it is undesirable to release such displaced fuel vapor into the atmosphere.

To avoid the release of displaced fuel vapor to the atmosphere, the vehicle fuel tank is typically connected to a fuel canister for venting the fuel vapor thereto. The fuel canister is adapted to temporarily retain the displaced vapor thereby preventing the displaced fuel vapor from being released into the atmosphere. More particularly, the displaced fuel vapor enters the fuel canister from the fuel tank wherein the fuel vapor is absorbed in a carbon bed contained within the fuel canister. The absorption of displaced fuel vapor within the canister displaces air within the canister. This air is vented to atmosphere.

The retention of the displaced fuel vapor within the canister is only temporary. More particularly, the fuel vapor retained in the fuel canister must be purged to allow the canister to accommodate and absorb additional displaced fuel vapor from fuel tank that may occur at a later time. To purge the absorbed fuel vapor, atmospheric air or purge air is drawn into the canister and through the carbon bed. The purge air passes a dust separator prior to entering the canister which cleans or filters the purge air. After passing through the canister, the purge air is sent to the engine for utilization. After purging, an amount of atmospheric air occupies the fuel canister until another amount of displaced fuel vapor enters the canister and forces the air therein to exit the canister.

In many prior art vehicle fuel systems, a tube or like conduit is attached at a first end to the fuel canister. The second end of the tube is secured to or within a body part or panel of the vehicle. The tube permits air to enter and exit the fuel canister as displaced fuel vapor exits and enters the fuel canister. The second end of the tube, secured to a body part or panel, is oriented such that water, snow, debris and the like are prevented from or have difficulty entering the tube and, therethrough, the canister.

In some vehicles there is not a suitable body part or panel to which the second end of the tube may be attached and oriented to discourage the entrance of water, snow, debris and the like. A vehicle body part or panel may be unsuitable because its location on the vehicle makes attaching the tube thereto impractical or it may be a part that if the tube was attached thereto, air exiting the tube could enter the passenger cabin of the vehicle. Allowing air to exit the tube into the vehicle cabin is undesirable because there is no filter to ensure that some fuel vapor does not enter the cabin with the air.

Thus, there is a need for a fuel system having a vent structure that permits atmospheric air to enter and exit a fuel canister while preventing or at least obstructing water, snow, debris and the like from entering the fuel canister when the vehicle has no suitable component for attaching a second end of a tube that communicates with the fuel canister. The present invention provides a new and improved fuel system having a vent structure that overcomes the foregoing difficulties and others and provides the aforementioned advantageous features.

BRIEF SUMMARY OF THE INVENTION

In accordance with one aspect of the present invention, a new and improved evaporative fuel system is provided. More particularly, in accordance with this aspect of the invention, the evaporative fuel system includes a canister connected to a fuel tank for receiving vapors therefrom and a conduit having a first end connected to the canister. A vent structure is connected to a second end of the conduit. The vent structure includes a housing first port formed in the housing and connected to the conduit, and a second port formed in the housing and connected to atmosphere. A chamber portion is formed by the housing and is in airflow communication with the second port. A tubular portion is formed by the housing and is in airflow communication with the first port and the chamber portion. The tubular portion extends into the chamber portion. A baffle is adjacent the second port and extends into the chamber. The baffle and the tubular portion together define a sinuous path portion of an air passageway extending between the first port and the second port.

According to another aspect of the present invention, a new and improved vent structure for an evaporative fuel canister is provided. More particularly, in accordance with this aspect of the invention, the vent structure includes a housing having a first end and a second end. A cavity is defined within the housing. A first ambient port is defined in the housing adjacent the second end and is connected to the cavity. A second ambient port is defined in the housing adjacent the second end and is connected to the cavity. The second ambient port is oriented below the first ambient port. A canister port is defined in the housing adjacent the first end and is connected to the cavity. The canister port is adapted to be connected to a port of an associated evaporative fuel canister. A fin is disposed in the cavity for directing fluid entering at least one of the first ambient port and the second ambient port to exit the cavity through at least one of the first ambient port and the second ambient port.

According to still another aspect of the present invention, a vent structure having an opening for allowing a connected fuel canister to vent airflow to atmosphere while preventing fluids from entering the canister through the opening is provided. More particularly, in accordance with this aspect of the invention, the vent structure includes a housing defining at least one air passageway therethrough. A first ambient port is defined in the housing connecting the at least one passageway to atmosphere. A second ambient port is defined in the housing connecting the at least one air passageway to atmosphere. A channel member defining a portion of the at least one air passageway is provided. The channel member has at least one canister port defined by the housing for connecting the at least one air passageway to the associated canister. A first baffle is adjacent the first ambient port. A second baffle is adjacent the second ambient port. The housing, the channel member and the first baffle together define a first air passageway of the at least one air passageway having a circuitous path between the first ambient port and the at least one canister port. The housing, the channel member and the second baffle together define a second air passageway of the at least one air passageway having a circuitous path between the second ambient port and the at least one canister port.

According to another aspect of the present invention, a new and improved canister vent is provided. More particularly, in accordance with this aspect of the invention, the canister vent includes a body having a first end and a second end. At least one canister port is defined by the body and located adjacent the first end. A cup portion is defined by the body. The cup portion has a base wall and at least one sidewall that together define a cup cavity adjacent the second end. A channel member extends into the cup cavity from the base wall. The channel member defines an opening spaced apart from the base wall. An air passageway fluidly connects the at least one canister port and the channel member opening. An end cap connects to the body for closing an open side of the cup cavity. The end cap includes at least one end cap port therethrough and at least one baffle extending into the cup cavity for obstructing direct flow between the at least one end cap port and the channel member opening.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
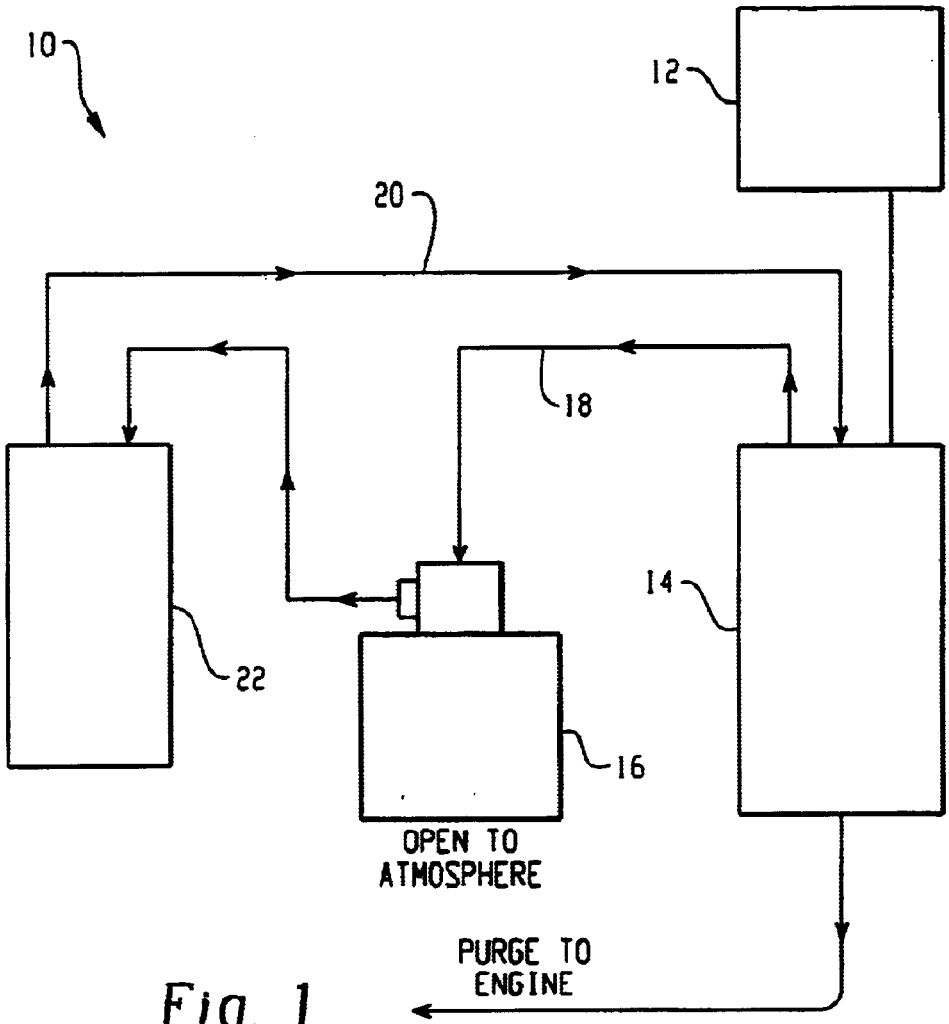
FIG. 1 is a schematic view of a portion of a vehicle fuel system having a fuel canister, a vent structure connected to the fuel canister and a dust separator according to a preferred embodiment of the present invention.

Referring now to the drawings wherein the showings are for purposes of illustrating a preferred embodiment of the invention only and not for purposes of limiting the same, FIG. 1 shows evaporative fuel system generally designated by reference numeral 10. It is noted that FIG. 1 shows the relevant parts of the fuel system 10 schematically, rather than for purposes of showing the relative size or location of the parts. The evaporative fuel system 10 includes a fuel tank 12 in fluid communication with a fuel canister 14 and a joint box or vent structure 16. A drain tube 18 fluidly communicates between the fuel canister 14 and the vent structure 16 and a filter tube 20 also fluidly communicates between the fuel canister 14 and the vent structure 16. The filter tube 20 includes a filter or filtering means for removing particulate matter passing through the filter tube 20 such as a dust separator 22. The evaporative fuel canister 14 includes a conventional fuel vapor absorbent material such as a carbon bed for temporarily absorbing and storing fuel vapor displaced from the fuel tank 12. The fuel canister 14 further includes an outlet port that is in fluid communication with the drain tube 18 and an inlet port that is in fluid communication with the filter tube or conduit 20. Thus, a first end of the drain tube or conduit 18 is connected to the fuel canister at the canister outlet port and a second end of the drain tube is connected to the vent structure 16. A first end of the filter tube 20 is connected to the vent structure 16 and a second end of the filter tube 20 is connected to the inlet port of the fuel canister 14.

Figure 2:
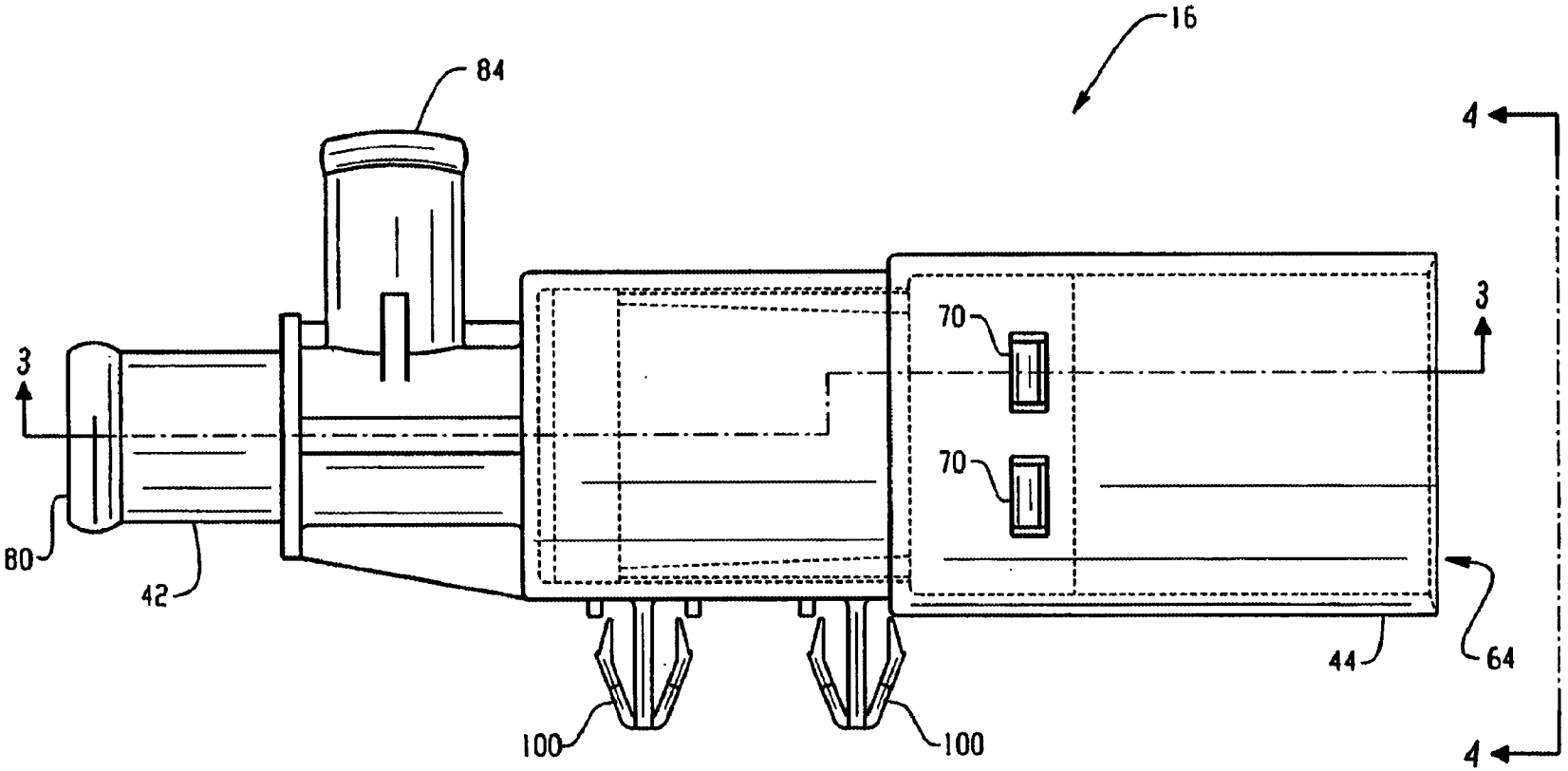
FIG. 2 is a side elevational view of the vent structure of FIG. 1.

With reference to FIG. 2, in a preferred embodiment, the vent structure 16 is a box-shaped housing or body having a first end 42 and a second end 44. With additional reference to FIG. 3, the vent structure 16 defines a cavity or chamber portion 46 as will be described in more detail below. A duct 48 extends into the cavity 46 and defines an internal passageway 50. The duct 48, also referred to herein as a tubular portion or a conduit, is connected to and in fluid or airflow communication with the cavity 46. A cylindrical channel member 52 defines a portion of the duct that extends into the cavity 46. A duct opening 54 is defined by the channel member 52 adjacent a distal end 56 of the channel member 52.

Figure 4:
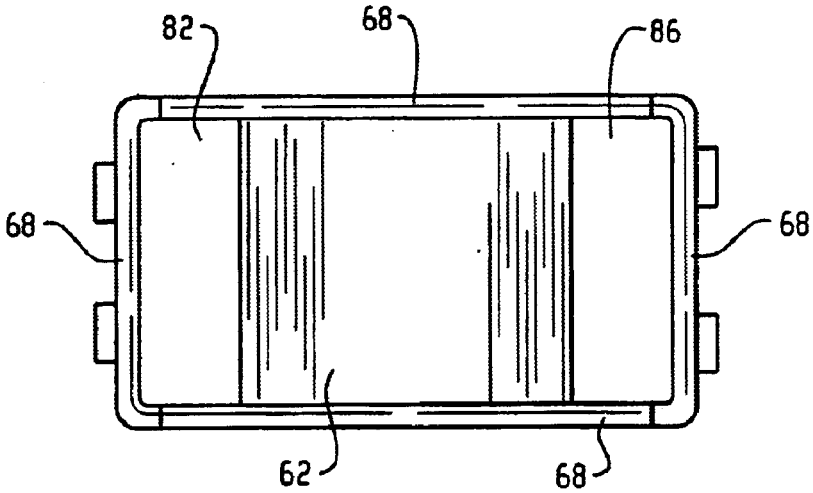
FIG. 4 is an end elevational view of the vent structure taken along the line 4—4 of FIG. 2.

The vent structure housing 16 is generally constructed of two components, a cup portion 60 and an end cap 62. The cup portion 60 includes the duct 48 and a cup-shaped cavity 64. As shown, a portion of the cup cavity 64 is also the cavity or chamber portion 46. The cup cavity 64 is adjacent the second end 44 of the vent structure 16. The cup cavity 64 is defined by a base wall 66 and a plurality of side walls 68 (FIG. 4). The end cap 62 is received within the cup cavity 64 and, together, the end cap 62 and the base wall 66 define the chamber portion 46. Thus, a portion of the cup cavity 64 extends beyond the end cap 62 in the direction of the second end 44. The sidewalls 68 may include finger openings 70 that receive fingers 72 of the end cap 62 for locking engagement between the end cap 62 and the cup portion 60. Of course, other means for connecting the end cap 62 and cup portion 60 together are contemplated and are to be considered within the scope of the present invention. For example, the end cap 62 can be connected to the cup portion 60 by a press-fit connection, use of a fastener, use of adhesives, etc. Alternatively, the vent structure could be molded as a single component.

Figure 3:
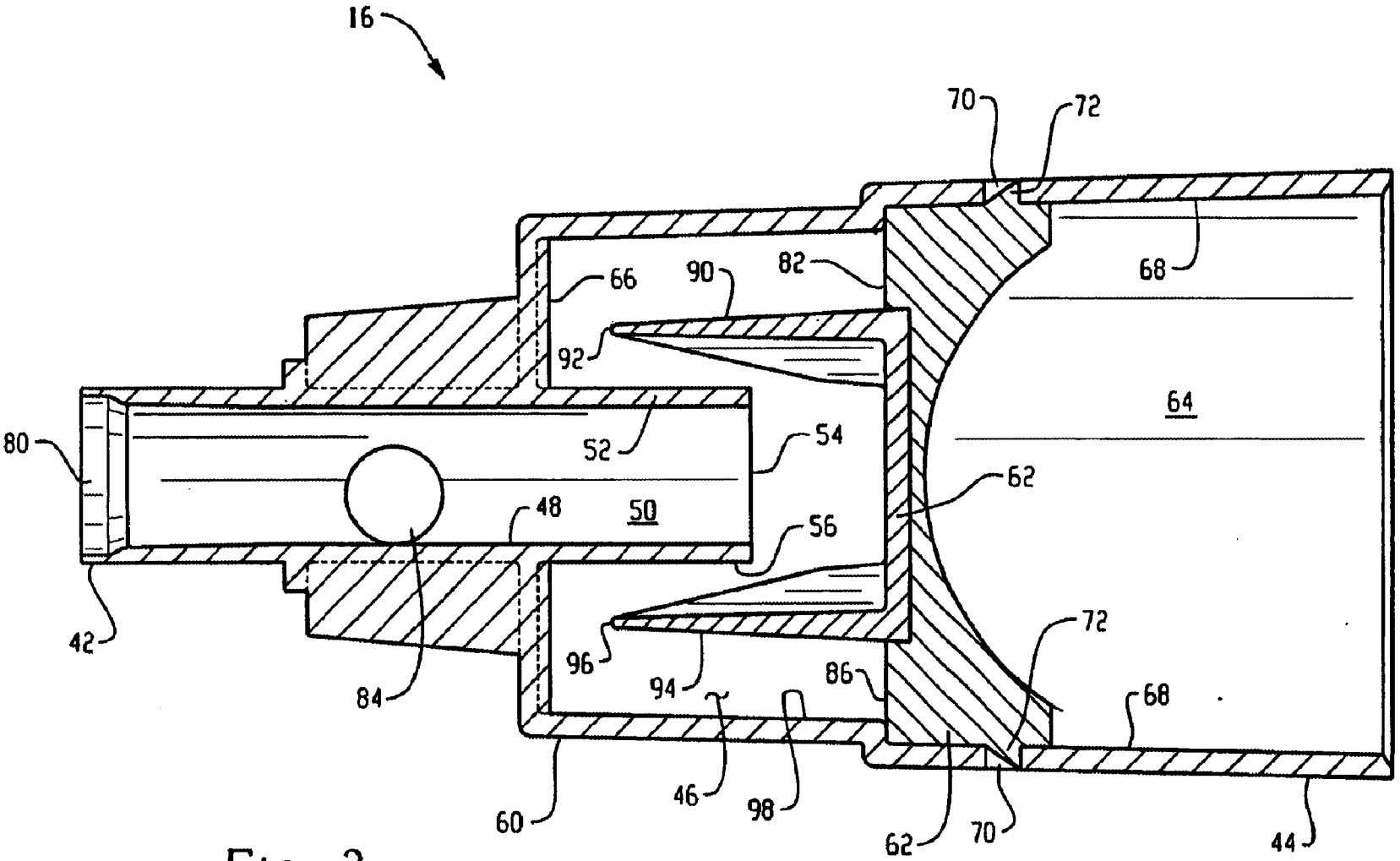
FIG. 3 is a cross-section view of the vent structure taken along the line 3—3 of FIG. 2.

With continuing reference to FIG. 3, the vent structure 16 includes a plurality of ports. More specifically, a first port or first canister port 80 is defined by the vent structure body 16 adjacent the first end 42. The first canister port 80 is connected to the cavity 46 and defined by the duct 48. More specifically, the first canister port 80 is in fluid or airflow communication with the cavity 46 through the duct 48. With additional reference to FIG. 4, a second port or opening 82, also referred to herein as a first ambient port and an end cap port, is defined in the end cap 62 adjacent the second end 44 of the vent structure body 16. The second port 82 is connected to and in fluid or airflow communication with the cavity 46.

A third port 84, also referred to herein as a second canister port, is defined by the vent structure body 16 adjacent the first end 42. The third port 84 is connected to and in fluid communication with the cavity 46. Specifically, the third port 84 is defined by the vent structure body 16 and is in fluid communication with the duct 48. A fourth port or opening 86, also referred to herein as a second ambient port and an end cap port, is defined in the end cap 62 adjacent the second end 44 of the vent structure body 16. The fourth port 86 is connected to and in fluid communication with the cavity 46. Further, the fourth port 86 is oriented below the first ambient port 82 as will be described in more detail below.

As mentioned above, in the illustrated embodiment, the vent structure 16 is connected to the fuel canister 14 by a drain tube 18 and a filter tube 20. Specifically, a second end of the drain tube 18 is connected to the first canister port 80. A second end of the filter tube 20 is connected to the second canister port 84. Other connections between the fuel canister 14 and the vent structure 16 are contemplated and all such connections that would be known to those skilled in the art are to be considered within the scope of the present invention and equivalents of the connection(s) illustrated and described herein. A few examples are hereafter provided for illustrative and non-limiting purposes only. Examples of alternative connections between the fuel canister 14 and the vent structure 16 include using only a single conduit, a single conduit that branches into two or more conduits, or a single conduit with two or more discrete fluid passageways in place of the drain tube 18 and the filter tube 20.

With specific reference to FIG. 3, the end cap 62 includes a first baffle or fin 90 that extends into the cavity 46. The first baffle 90 is positioned adjacent and below the first ambient port 82. A distal end 92 of the first baffle 90 extends beyond the distal end 56 of the channel member 52. A second baffle or fin 94 extends from the end cap 62 into the cavity 46. The second baffle 94 is positioned adjacent and above the second ambient port 86. The first baffle 90 is longer in length than the second baffle 94. More specifically, the distal end 92 of the first baffle 90 is spaced apart from the generally planar portion of the end cap 62 farther than a distal end 96 of the second baffle 94. The baffles 90,94 are used to obstruct direct flow between the first and second ambient ports 82,86, respectively, and the internal passageway 50 of the duct 48.

The vent structure 16 includes a means for obstructing fluid or water, snow, debris and the like from entering the fuel canister 14 while permitting atmospheric air to enter the same. In the embodiment illustrated, the means for obstructing water, snow, debris and the like from entering the fuel canister 14 while permitting atmospheric air to enter the same is a tortuous or labyrinthine path between the first canister port 80 and the ambient ports 82,86 and between the second canister port 84 and the ambient ports 82,86. More specifically, the first and second canister ports 80,84 connect and are in fluid communication with the internal passageway 50 of the duct 48. A first air passageway extends between the first ambient port 82 and the internal passageway 50. A second air passageway extends between the second ambient port 86 and the internal passageway 50. A portion of the first air passageway is a first sinuous or circuitous path. The first circuitous path is defined by the first baffle 90, the channel member 52, and the vent structure housing 16. A portion of the second air passageway is a second sinuous or circuitous path. The second circuitous path is defined by the second baffle 94, the channel member 52, and the vent structure housing 16. Thus, direct flow between ambient ports 84,86 and the internal passageway 50 is obstructed. The circuity of these paths, i.e., the obstruction of direct flow, tends to prevent water, snow, debris and the like from entering the ambient ports 84,86 and passing through to the internal passageway 50 while permitting air to pass between the ambient ports 84,86 and the internal passageway 50.

As described above, when in use, fuel vapors may pass from the fuel tank 12 to the canister 14, air contained within the canister 14 is then displaced. The displaced air passes from the fuel canister 14 through the drain tube 18 and enters the vent structure 16 through the first canister port 80. From the first canister port 80, the displaced air passes through the first and second air passageways, and their sinuous paths, to the first and second ambient ports 82,86.

When the canister 14 is purged, atmospheric air enters the vent structure 16 through the open side of the cup cavity 64 and into the first and second ambient ports 82,86. The atmospheric or purge air then passes through the first and second air passageways, and their sinuous paths, to the filter tube 20. Once in the filter tube 20, the air passes through the dust separator 22 and then enters the fuel canister 14. Whether air from the drain tube passes to the first and second ambient ports 82,86 or atmospheric air passes from the first and second ambient ports 82,86 to the filter tube 20, the air must flow through either or both the circuitous paths defined within the vent structure 16.

The vent structure 16 further includes a means for directing water, snow, debris and the like entering either the first or second ambient ports 82,86 to exit the vent structure 16. More particularly, as mentioned above, the first baffle 90 extends beyond the distal end 56 of the channel member 52. The first baffle 90 is angled slightly to urge, with the assistance of gravity, water, snow, debris and the like toward and past the distal edge 92 of the first baffle 90. Thus, water, snow, debris and the like that passes over the distal edge 92 will fall, due to gravity, around the tubular-shaped channel member 52, past the relatively shorter second baffle 92 and to the bottom wall 98 of the sidewalls 68. Beneath the distal edge 92, the channel member 52 has a tubular cross-section. Beneath the channel member 52, the second baffle 94 does not extend as far into the cavity 46 from the end cap 62 as does the first baffle 90. The bottom wall 98 adjacent the second ambient port 86 is also angled slightly toward the second ambient port 86 to urge, again with the assistance of gravity, any water, snow, debris and the like that is at the bottom wall 98 to exit the vent structure 16 through the second ambient port 86.

More specifically, if water, snow, or debris enters the second ambient port 86, this matter is directed by the downward sloping wall 98 back toward the second ambient port 86. If water, snow, debris and the like enters the first ambient port 82, the matter is directed by the downward sloping first baffle 90 toward and past the distal edge 92 of the first baffle 90. Once the matter passes beyond the distal end 92 of the first baffle or fin 90, the matter, due to gravity and the orientation of the vent structure 16, falls on or around the channel member 52. Anything that falls directly on the channel member 52 is directed around the channel member 52 due to the tubular or cylindrical nature of the channel member 52. The abbreviated length of the second baffle relative to the first baffle, removes the second baffle 94 as an obstruction to this matter falling all the way to the angled bottom wall 98. Once at the bottom wall 98, the matter is directed by the slope of the bottom wall 98 toward the second ambient port 86 where the matter can exit the vent structure 16.

Thus, when the vent structure housing 16 is in a horizontal orientation, the first ambient port 82 is relatively higher than the second ambient port 86. The channel member 52 extends into the cavity 46 between the first and second baffles 90,94. This arrangement directs fluid or water, snow, debris and the like entering the first or second ambient ports 82,86 back out through the first or second ambient ports 82,86 while allowing air to pass to the internal passageway 50 of the channel member 52. The connection between the end cap 62 and the cup portion 60, i.e., the fingers 72 and finger openings 70 in the illustrated embodiment, can be designed to only allow the end cap 62 to connect to the cup portion 60 when the first ambient port 82 is properly positioned above (when the vent structure 16 is in a horizontal orientation) the second ambient port 86. For example, the spacing between the finger openings 70 adjacent the first ambient port 82 can be different than the spacing between the finger openings 70 adjacent the second ambient port 86. With reference back to FIG. 2, the vent structure 16 further includes a pair of connectors 100 for mounting the vent structure 16 to a flange or other structure on a vehicle.

Alternatively, the first baffle 90 could be angled to direct water, snow, debris and the like that enters the first ambient port 82 back out to atmosphere through the first ambient port 82. In this arrangement, only matter that overcomes the slope of the first baffle 90 is directed by gravity to the bottom wall 98. Then, all matter along the bottom wall 98 is urged out the second ambient port 86 as described above.

The invention has been described with reference to the preferred embodiments. Obviously, modifications and alteration will occur to others upon reading and understanding the preceding detailed description. It is intended that the invention be construed as including all such modifications and alterations insofar as they are within the scope of the appended claims and the equivalents thereof.

Having thus described the preferred embodiments, the invention is now claimed to be:

1. An evaporative fuel system, comprising:

a canister connected to a fuel tank for receiving vapors therefrom;

a conduit having a first end connected to the canister; and a vent structure connected to a second end of the conduit, the vent structure including:

a housing, a first port formed in the housing and connected to the conduit, a second port formed in the housing and connected to atmosphere, a chamber portion formed by the housing and in airflow communication with the second port, a tubular portion formed by the housing and in airflow communication with the first port and the chamber portion, the tubular portion extending into the chamber portion, a baffle adjacent the second port extending into the chamber, the baffle and the tubular portion together defining a sinuous path portion of an air passageway extending between the first poll and the second port.

2. The evaporative fuel system of claim 1 further comprising a cleaner conduit connected at a first end to the canister and at a second end to a third port formed in the vent structure housing, the third port connecting to the air passageway at a location between the first port and the sinuous path portion, the cleaner conduit including a filter for removing particulate matter from the air passing through the cleaner conduit.

3. The evaporative fuel system of claim 1 wherein the vent structure includes:

a fourth port formed in the housing for connecting the chamber to atmosphere;

a second baffle adjacent the fourth port extending into the chamber, the second baffle and the tubular portion together defining a second sinuous path portion of the air passageway.

4. A vent structure for an evaporative fuel canister, the vent structure comprising:

a housing having a first end and a second end;

a cavity defined within the housing;

a first ambient port defined in the housing adjacent the second end and connected to the cavity;

a second ambient port defined in the housing adjacent the second end and connected to the cavity, the second ambient port oriented below the first ambient port;

a canister port defined in the housing adjacent the first end and connected to the cavity, the canister port adapted to be connected to a port of an associated evaporative fuel canister;

a fin disposed in the cavity for directing fluid entering at least one of the first ambient port and the second ambient port to exit the cavity through at least one of the first ambient port and the second ambient port.

5. The vent structure of claim 4 wherein the fin is positioned adjacent at least one of the first ambient port and the second ambient port to define a tortuous path between at least one of (1) the canister port and the first ambient port and (2) the canister port and the second ambient port.

6. The vent structure of claim 4 wherein the canister port is defined by a duct that extends into the cavity, the fin is positioned below the first ambient port and extends into the cavity to at least a distal edge of the duct and the second ambient port is positioned adjacent a sloped surface adapted to direct fluid toward the second ambient port.

7. The vent structure of claim 6 wherein the duct is a tubular conduit.

8. The vent structure of claim 4 wherein the housing includes connections for mounting the vent structure to an associated vehicle body.

9. A vent structure having an opening for allowing a connected fuel canister to vent air flow to atmosphere while preventing fluids from entering the canister through the opening, the vent structure comprising:

a housing defining at least one air passageway therethrough;

a first ambient port defined in the housing connecting the at least one passageway to atmosphere;

a second ambient port defined in the housing connecting the at least one air passageway to atmosphere;

a channel member defining a portion of the at least one air passageway, the channel member having at least one canister port defined by the housing for connecting the at least one air passageway to the associated canister;

a first baffle adjacent the first ambient port;

a second baffle adjacent the second ambient port;

the housing, the channel member and the first baffle together defining a first air passageway of the at least one air passageway having a circuitous path between the first ambient port and the at least one canister port; and the housing, the channel member and the second baffle together defining a second air passageway of the at least one air passageway having a circuitous path between the second ambient port and the at least one canister port.

10. The vent structure of claim 9 wherein the housing is positioned in a horizontal orientation whereby the first ambient port is positioned relatively higher on the housing than the second ambient port, the first baffle is positioned below the first ambient port, the second baffle is positioned above the second ambient port, and the channel member extends to a position between the first and second baffles.

11. The vent structure of claim 10 wherein the first baffle is angled to urge fluid toward the first ambient port.

12. The vent structure of claim 10 wherein a bottom wall of the housing adjacent the second ambient port is angled to urge fluid toward the second ambient port.

13. The vent structure of claim 12 wherein the first baffle is angled to urge fluid toward a distal end of the first baffle.

14. The vent structure of claim 12 wherein the first baffle is longer in length than the second baffle so that fluid entering the first ambient port that passes beyond a distal end of the first baffle is directed by gravity to the bottom wall.

15. The vent structure of claim 14 wherein the channel member is cylindrical to further direct fluid passing the distal end of the first baffle to the bottom wall.

16. The vent structure of claim 9 wherein the housing is shaped for attachment to a flat vehicle component.

17. A canister vent comprising:

a body having a first end and a second end;

at least one canister port defined by the body and located adjacent the first end;

a cup portion defined by the body, the cup portion having a base wall and at least one side wall that together define a cup cavity adjacent the second end;

a channel member extending into the cup cavity from the base wall, the channel member defines an opening spaced apart from the base wall;

an air passageway fluidly connecting the at least one canister port and the channel member opening; and an end cap connecting to the body for closing an open side of the cup cavity, the end cap including at least one ambient port therethrough and at least one baffle extending into the cup cavity for obstructing direct flow between the at least one ambient port and the channel member opening.

18. The canister vent of claim 17 wherein the baffle and the channel member together define a labyrinthine path between the at least one port and the passageway.

19. The canister vent of claim 17 wherein the end cap includes a first ambient port located at a position relatively above the channel member and a second ambient port located at a position relatively below the channel member, and the at least one baffle includes a first baffle adjacent and below the first ambient port and a second baffle adjacent and above the second ambient port.

20. The canister vent of claim 17 wherein the at least one side wall includes openings for receiving fingers of the end cap for securely connecting the end cap to the body.

* * * * *